US006158739A

United States Patent [19]

Engelke

[11] Patent Number: 6,158,739

[45] Date of Patent: Dec. 12, 2000

[54] SPINNER DEVICE FOR A PUT AND TAKE GAME

[75] Inventor: William A. Engelke, Troy, N.Y.

[73] Assignee: Want Ad Digest Incorporated, Troy, N.Y.

[21] Appl. No.: 09/259,066

[22] Filed: Feb. 26, 1999

[51] Int. Cl.[7] ..... A63F 5/04

[52] U.S. Cl. ..... 273/147

[58] Field of Search ..... 273/147, 143 A; 446/256, 264, 257, 258

[56] References Cited

U.S. PATENT DOCUMENTS

| | | | |
|---|---|---|---|
| D. 320,240 | 9/1991 | Stefanou | D21/95 |
| 1,395,261 | 11/1921 | Cullinan | 273/147 |
| 1,529,263 | 3/1925 | McGinnis | 273/147 |
| 1,587,580 | 6/1926 | Dutton | 273/146 |
| 2,311,453 | 2/1943 | McKeown | 273/147 |
| 2,332,507 | 10/1943 | Dailey | 273/147 |
| 4,515,372 | 5/1985 | Gonzales | 273/274 |
| 4,834,372 | 5/1989 | Velazquez | 273/147 |
| 4,856,784 | 8/1989 | Magee | 273/147 |

*Primary Examiner*—Benjamin H. Layno
*Attorney, Agent, or Firm*—Schmeiser, Olsen & Watts

[57] ABSTRACT

A spinner device for a put and take game. The spinner device comprises a base portion having a rounded conical profile, a middle portion that includes a hollow core, and a stem that extends up through the hollow core from the solid base portion and out of the middle portion to provide a handle for spinning. The spinner device having game play indicia that comprises both an action and an amount.

18 Claims, 1 Drawing Sheet

SPINNER DEVICE FOR A PUT AND TAKE GAME

BACKGROUND OF THE INVENTION

1. Technical Field

The present invention relates to games of chance that utilize spinning devices, and more particularly, to a put and take game spinning mechanism.

2. Related Art

Put and take type games utilizing spinning devices have been used for years. Probably the earliest such example is the dreidel which dates back to biblical times. Recently however, there have been various modifications and variations to the classic put and take game. Such variations alter the outcome of the spin, or provide some other functional feature in the spinner itself. Examples of such prior art games include U.S. Pat. No. 4,856,784, issued on Aug. 15, 1989 to Magee entitled "Casino Game"; U.S. Pat. No. 4,834,372, issued on May 30, 1989 to Velazquez, entitled "Chance Determining Device"; U.S. Pat. No. 4,515,372, issued on May 7, 1985 to Gonzales, entitled "Game Device"; and U.S. Pat. No. 1,529,263, issued on Mar. 10, 1925 to McGinnis, entitled "Game Device." In general, the games utilize a spinning device having a plurality of flat sides, each dictating an action to be taken. For example, the action might dictate that the person spinning the device to "put" a fixed amount of money into the pot, or "take" the fixed amount of money out of the pot.

Accordingly, while there has been a large emphasis on finding and developing variations to games of chance, little effort has been directed at providing a more elaborate put and take game, or for improving the spinner itself. For example, prior art spinners often do not spin for very long before falling over. Moreover, other spinners tend to fall over only partially and therefore fail to always land on a flat side thereby causing confusion and requiring a respin. Finally, prior put and take games involving a spinner do not include outcomes that involve both an action and a variable amount.

SUMMARY OF THE INVENTION

The present invention provides an improved spinning device for playing a put and take game wherein the spinner includes a solid base having: (1) a rounded conical profile that tapers down to a point; (2) a middle section having a solid peripheral wall, and a hollow central region; and (3) a stem extending from the solid base, through the middle section and out to provide a handle for spinning. In addition, the middle section may further comprise ribs extending between the solid peripheral wall and the stem to form a plurality of hollow cores within the spinner. The spinner may further comprise a plurality of flat exterior surfaces each containing some indicia that determines an Outcome of the spin. By providing such a hollowed-out configuration, better spinning characteristics are achieved. In addition, less material is required to build and ship the units, thereby providing an economical advantage.

Furthermore, the present spinner comprises a put and take game that includes both an action (e.g., put and take), and a variable amount (e.g., put 4 or take 2). Thus, the present invention provides a put and take game on a spinner with more possible outcomes.

It is therefore an advantage of the present invention to provide a spinner that has a hollowed interior region to promote better spinning properties, and ease of manufacture.

It is therefore a further advantage of the present invention to provide a spinner comprising hollow interior cores to promote improved spinning characteristics, and ease of manufacture.

BRIEF DESCRIPTION OF THE DRAWINGS

These and other benefits and advantages of the novel spinning device and game of the present invention will be apparent from the following description and accompanying drawings in which.

DETAILED DESCRIPTION OF THE DRAWINGS

Figure 1:
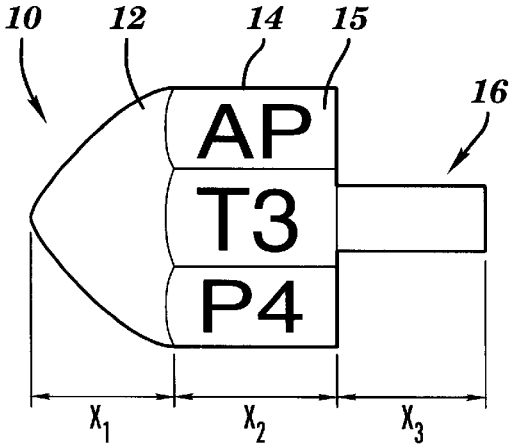
FIG. 1 is a side view of a spinner in accordance with a preferred embodiment of the present invention.

Referring now to the drawings, FIG. 1 depicts an exterior side view of a spinner 10 in accordance with a preferred embodiment of the invention. Spinner 10 comprises a solid base portion 12, a middle portion 14 adjacent solid base portion 12, and a stem 16. The solid base portion 12 may comprise a rounded conical profile that tapers to a point on which the spinner 10 can be spun. One novel characteristic of the spinner 10 involves the relative sizes of the solid base portion 12, middle portion 14, and stem 16. In particular, spinner 10 is designed such that middle portion 14 length ($X_2$) is slightly longer than stem 16 length ($X_3$), and stem 16 is slightly longer than solid base portion 12 length ($X_1$). Moreover, the cross-sectional width of middle portion 14 ($X_4$) is approximately the same as the combined length of middle portion 14 and solid base portion 12. Typical dimensions in inches for these parts may be as follows. Overall length ($X_1+X_2+X_3$): 1 11/16 inches; solid base portion length ($X_1$): 9/16 inches; middle section length ($X_2$): ¾ inches; and stem length ($X_3$): ⅝ inches.

In addition, spinner 10 includes various indicia 15 that appear on the exterior surfaces of the middle portion 14. This indicia 15 is described in more detail below with regard to FIG. 6.

Figure 2:
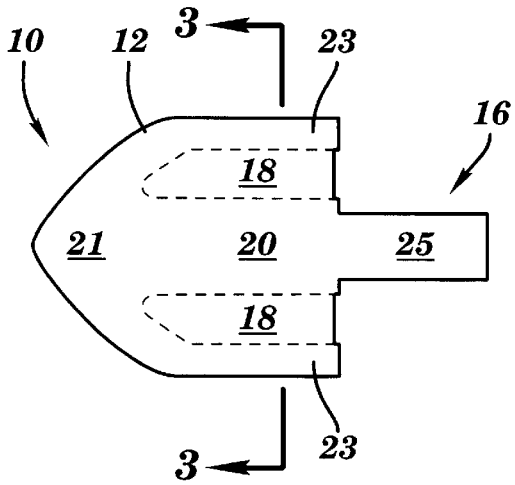
FIG. 2 is a cross-sectional side view of the spinner of FIG. 1 in accordance with a preferred embodiment of the present invention.

Referring now to FIG. 2, a cross-sectional side view of spinner 10 is depicted. As can be seen, an interior of the spinner 10 comprises a solid region 21 within the solid base portion 12. The spinner's middle section 14 includes solid peripheral walls 23 along with hollow cores 18. Stem 16 comprises a first part 25 that extends beyond middle portion 14 of spinner 10, and a second part 20 that resides within middle portion 14 of spinner 10 and connects to solid portion 21 within base portion 12 of the spinner 10. Stem second part 20 has a slightly larger diameter than stem first part 25 and acts as a stem support. By having stem 16 extend from solid base portion 12 through the middle section 14 and out, a hollow interior region is created and greater spinning characteristics are achieved. In addition, less material is required to build the spinner, thereby reducing both manufacturing and shipping costs.

Figure 3:
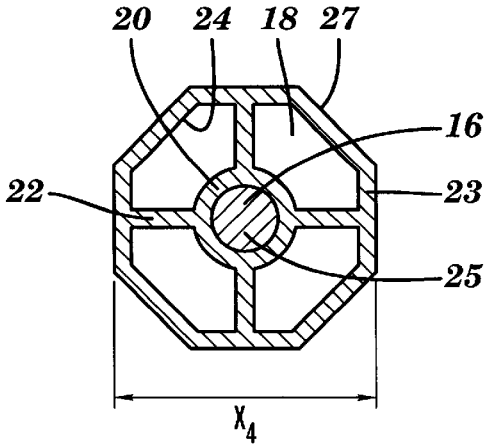
FIG. 3 is a cross-sectional front view taken along cross-section A—A, in accordance with a preferred embodiment of the present invention.

Referring now to FIG. 3, a cross-sectional front view is shown along section A—A of FIG. 2. As can be seen, stem 16 comprises first part 25 and second part 20 of differing diameters. The two stem parts 20 and 25 may be fabricated from a single piece of material, or two separate pieces. Peripheral wall 23 forms a plurality of flat sides 27 on an exterior of middle section 14, as well as a plurality of interior sides 24 along an interior of middle section 14. In addition, a plurality of ribs 22 connecting stem second part 20 with peripheral wall 23 form a plurality of hollow cores 18.

Figure 4:
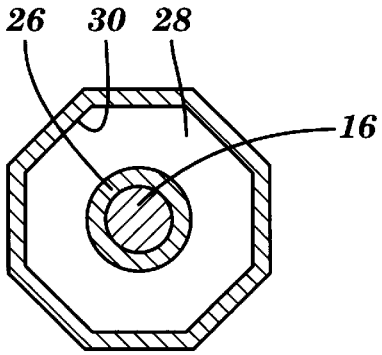
FIG. 4 is a cross-sectional front view depicting an alternate embodiment.
Figure 5:
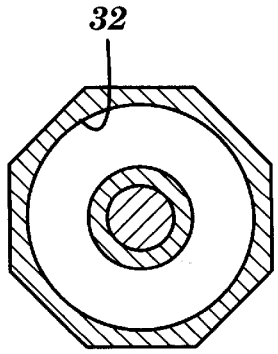
FIG. 5 is a cross-sectional front view depicting a second alternative embodiment.

Referring now to FIG. 4, a cross-section of an alternative embodiment is depicted that is essentially the same as that depicted in FIG. 3 except that it does not include the plurality of ribs 22. Accordingly, a unitary hollow region 28 is formed, as opposed to a plurality of hollow cores 18 as shown in FIG. 3. This particular embodiment includes a peripheral wall 23 that has a polygonal interior wall profile 30. FIG. 5 depicts a cross-section of a second alternative embodiment. The FIG. 5 embodiment is essentially the same as that depicted in FIG. 4, with the exception that an interior wall 32 is rounded, as opposed to polygonal.

Figure 6:
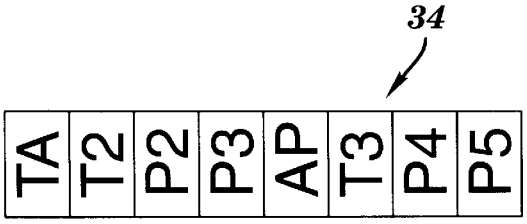
FIG. 6 is an exploded view of the indicia as it would appear on the exterior of the spinner in accordance with a preferred embodiment of the present invention.

FIG. 6 depicts the indicia that may appear on each of the plurality of flat exterior surfaces (i.e., faces) of middle section 14 of the spinner 10. Each face comprises some outcome for the person spinning the spinner 10. In this preferred embodiment, there exists eight exterior surfaces with the following actions: TA for take all; T2 for take two; P2 for put two; P3 for put three; AP for all put; T3 for take three; T4 put four; and P5 for put five. Other variations are, of course, within the scope of this invention.

While this invention has been described in conjunction with the specific embodiments outlined above, it is evident that many alternatives, modifications and variations will be apparent to those skilled in the art. Accordingly, the preferred embodiments of the invention as set forth above are intended to be illustrative, not limiting. Various changes may be made without departing from the spirit and scope of the invention as defined in the following claims.

What is claimed is:

1. A spinnable top, comprising:

a base portion having a substantially rounded conical profile;

a middle portion disposed above the solid base portion, the middle portion having a solid peripheral wall, a hollow core and at least three ribs connecting the stem to the said peripheral wall, wherein the solid peripheral wall comprises a plurality of flat exterior faces having indicia for game playing purposes; and a stem affixed to the solid base portion, and extending through and way from the hollow core of the middle portion to provide a handle for spinning the spinnable top.

2. The spinnable top of claim 1, wherein the plurality of ribs are equally spaced around the stem.

3. The spinnable top of claim 1, wherein the stem includes a first part having a first diameter that resides outside the middle portion, and a second part having a second diameter that is disposed within the middle portion, the second diameter being greater than the first diameter.

4. The spinnable top of claim 3, wherein the middle portion further comprises a plurality of ribs that connect the second part of the stem to the solid peripheral wall.

5. A spinner, comprising:

a solid base having a rounded conical profile;

a middle section having an outer peripheral wall, a stem support, a hollow central region disposed between the outer peripheral wall and the stem support and at least three ribs connecting the stem support to the outer peripheral wall; and a stem extending from the stem support to provide a handle for spinning the spinner.

6. The spinner of claim 5, wherein the outer peripheral wall has a polygonal cross-section.

7. The spinner of claim 6, wherein the stem support has a circular cross-section.

8. The spinner of claim 7, wherein the outer peripheral wall has a plurality of flat exterior faces that include indicia for game playing purposes.

9. The spinner of claim 8, wherein each of the ribs are equally spaced about the middle section.

10. The spinner of claim 9, wherein the outer peripheral wall has a plurality of flat interior faces.

11. The spinner of claim 10, wherein each rib is affixed to a middle of one of the flat interior faces.

12. The spinner of claim 11, wherein the outer peripheral wall comprises eight flat interior and exterior faces.

13. The spinner of claim 12, wherein the middle section comprises four ribs that form four hollow cores.

14. The spinner of claim 7, wherein the outer peripheral wall comprises a plurality of flat exterior faces and a substantially circular interior face.

15. The spinner of claim 7, wherein the indicia comprises both an action and a variable amount.

16. The spinner of claim 7, wherein the action is either put or take, and the variable amount is an integer value.

17. The spinner of claim 5, wherein a combined length of the solid base and middle section is less than a cross-sectional diameter of the middle section.

18. The spinner of claim 5, wherein a combined length of the middle section and stem is approximately the same as a cross-sectional diameter of the middle section.

* * * * *